US005707206A

United States Patent [19]

Goto et al.

[11] Patent Number: 5,707,206

[45] Date of Patent: Jan. 13, 1998

[54] TURBOMACHINE

[75] Inventors: Akira Goto, Tokyo; Tatsuyoshi Katsumata, Kanagawa-ken, both of Japan

[73] Assignee: Ebara Corporation, Tokyo, Japan

[21] Appl. No.: 683,069

[22] Filed: Jul. 16, 1996

[30] Foreign Application Priority Data

Jul. 18, 1995 [JP] Japan ..... 7-205299
Jul. 9, 1996 [JP] Japan ..... 8-179604

[51] Int. Cl.[6] ..... F01D 5/20

[52] U.S. Cl. ..... 415/173.1; 415/914

[58] Field of Search ..... 415/173.1, 58.2, 415/914

[56] References Cited

U.S. PATENT DOCUMENTS

| | | | |
|---|---|---|---|
| 3,365,172 | 1/1968 | McDonough et al. | 415/914 |
| 3,462,071 | 8/1969 | Garve | 230/114 |
| 3,887,295 | 6/1975 | Yu . | |
| 3,893,787 | 7/1975 | Jones | 415/914 |
| 4,063,848 | 12/1977 | Wiggins et al. | 415/194 |
| 4,086,022 | 4/1978 | Freeman et al. | 415/914 |
| 4,732,531 | 3/1988 | Minoda et al. | 415/914 |
| 5,236,301 | 8/1993 | Palmer . | |
| 5,246,335 | 9/1993 | Mitsubori et al. | 415/914 |
| 5,282,718 | 2/1994 | Koff et al. | 415/914 |
| 5,333,990 | 8/1994 | Foerster et al. | 415/914 |
| 5,458,457 | 10/1995 | Goto et al. | 415/115 |

FOREIGN PATENT DOCUMENTS

| | | |
|---|---|---|
| 0 092 955 | 11/1983 | European Pat. Off. . |
| 606 475 A1 | 7/1994 | European Pat. Off. . |
| 971622 | 2/1959 | Germany . |
| 42 13 047 A1 | 10/1993 | Germany . |
| 39-13700 | 7/1939 | Japan . |
| 55-35173 | 3/1980 | Japan . |
| 56-167813 | 12/1981 | Japan . |
| 2 191 606 | 12/1987 | United Kingdom . |
| 2245312 | 1/1992 | United Kingdom . |
| 2 285 485 | 12/1995 | United Kingdom . |

OTHER PUBLICATIONS

A Study of Configurations of Casing Treatment for Axial Flow Compressors, By Hideo Fujita and Hiroyuki Takata, Bulletin of JSME, vol. 27, No. 230 Aug. 1984.

Compressor Aerodynamics, By N.A. Cumpsty, copublished by Longman Scientific & Technical and John Wiley & Sons, Inc.

Technology of Controlling Stalling in Compressors, By Hiroyuki Takata, Text for the 181st Seminar of JSME Kansai Branch, May 16 and 17, 1991.

Patent Abstracts of Japan, Publication No. JP55035173; Publication date Mar. 12, 1980.

*Primary Examiner*—John T. Kwon

*Attorney, Agent, or Firm*—Armstrong, Westerman, Hattori, McLeland & Naughton

[57] ABSTRACT

A turbomachine having an impeller rotating within a casing of the machine and groove passages are formed in a wall of the casing between an upstream portion and a downstream portion of the impeller and high pressure fluid is injected into the groove passages for increasing the stall margin without lowering the peak efficiency of the machine and prevents generation of a positive slope in a head-capacity curve.

12 Claims, 18 Drawing Sheets dir=1500
a
b
c
d
e
HEAD
H(mmAq)
100
80
60
40
20
0
CAPACITY
Q(m3/min)
0
20
40
60
80
100
120
140
160
180
200 a b c d e

TURBOMACHINE

BACKGROUND OF THE INVENTION

1. Field of the Art

The present invention relates to a turbomachine (for example, a centrifugal compressor, an axial or mixed flow type compressor, a blower, or a pump), and more particularly, it relates to a turbomachine in which a surge margin can be expanded without reduction in peak efficiency.

2. Prior Art

FIG. 17(*a*) is a sectional view showing the vicinity of an inlet portion of a conventional turbomachine, and FIG. 17(*b*) is a sectional view of an impeller taken along the line 2—2 in FIG. 17(*a*). As shown, when an impeller 1 is rotated around an axis 2 of rotation within a casing 3, a fluid is sucked into the casing 3 through a suction port (not shown) and is discharged out of a discharge port (not shown).

In a conventional turbomachine of this kind, a secondary flow is generated by a blade tip leakage vortex 30 caused by a leakage flow passing across the blade tip and a passage vortex 31 caused by a pressure gradient existing between the blade suction surface and the blade pressure surface. The high-loss fluid caused in the impeller is apt to be accumulated in an area 32 where the two secondary flows interact with each other. In a partial capacity range of the machine, the secondary flow caused by the passage vortex 31 is dominant and, therefore, the high-loss fluid is apt to be accumulated in a corner region 33 between the blade suction surface and the casing inner wall surface.

Thus, large-scale separation of flow occurs owing to the unstable high-loss fluid, i.e., a low-momentum fluid on the blade surface and/or the casing wall surface. As a result, a head-capacity curve having a positive slope is caused in a partial capacity range, as shown by the line A in FIG. 18. Such positively-sloped characteristics of the head-capacity curve are known as stall phenomenon, which may induce surging, i.e., self-induced vibration of a turbomachine piping system, and may also cause vibration, noise and damage to the machine. Thus, such a stall phenomenon is a serious problem to be solved in order to attain stable operation of the turbomachine.

Conventional means for solving such a problem may be roughly divided into passive means supplied with no energy input from the outside of the turbomachine, and active means supplied with some energy input from the outside of the turbomachine.

The known passive means include a means in which grooves, which are referred to as casing treatment, are provided in the inner wall of the casing, and means referred to as an air separator in which an annular passage with guide vanes is provided in a casing wall at an impeller inlet portion (see the teaching material for the 181th course sponsored by the Kansai Branch of the Japan Society of Mechanical Engineers, pp. 45–56). Regarding the casing treatment, much study has been carried out on axial flow compressors and a various configurations have been proposed, such as an axial slot type, a circumferential groove type, a honeycomb type and so on (Cumpsty N. A., 1989, Compressor Aerodynamics, Longman Scientific & Technical). Fujita, H. and Takaka, H. has systematically carried out experiment on an influence of a variety of casing treatment on the performance of an axial flow compressor (1984, Bulletin of JSME, Vol. 27, No. 230, pp. 1675–1681). As is clear from the test result of this study (see FIG. 10 explained hereinafter), in a conventional casing treatment, there is a tendency that when a stall margin improvement is large, a reduction in peak efficiency of the machine is also inevitably large. A conventional casing treatment applied to the turbomachine having a centrifugal impeller is, for example, shown in U.S. Pat. Nos. 3,893,787 and 4,063,848.

Further, widely employed in the turbomachine is a means in which a fluid is bypassed from the discharge side to the inlet side during the operation in the partial capacity range. However, this means increases the actual flow rate of the fluid flowing through the turbomachine, and it inevitably causes a marked reduction in the head of the turbomachine. In addition, since a large amount of fluid recirculates through the bypass, a great deal of power is wasted.

On the other hand, the conventional active means may be roughly divided into the following four types:

(1) Means for externally supplying energy to the low-momentum fluid on the blade surface, the casing and/or the shroud;

(2) Means for removing such a low-momentum fluid;

(3) Means for giving a prerotation to the impeller inlet flow, in the direction of the impeller rotation, to thereby prevent blade stall; and (4) Means for actively generating disturbance to dump a weak unstable fluid oscillation that appears in the flow field before stall occurs.

As one example of the above means (1), Japanese Patent Laid-Open No. 55-35173 (1980) discloses a method for expanding a surge margin in a compressor, in which part of the high-pressure side fluid is introduced to the tip part of the impeller and/or the area between each pair of adjacent blades, thereby injecting it in the form of a high-speed jet. According to this literature, the direction of the jet may be any of a radial direction, direction of rotation of the impeller and a direction counter to the impeller rotation. Jet injection is equally effective in any of these three directions. Since the function of the jet in this prior art is to supply energy to the unstable low-momentum fluid on the blade surface and to thereby prevent boundary-layer separation, the direction of injection need not be particularly specified.

As another known example of the means (1), Japanese Patent Laid-Open No. 45-14921 (1970) discloses a means in which high-pressure air is taken out from the discharge side of a centrifugal compressor and is jetted out of a nozzle provided in a part of the casing that covers the downstream half of the impeller to thereby stabilize the operation during the partial capacity range. The function of the jet in this means involves a turbine effect which provides pressure to the low-pressure region at the blade rear side (blade suction surface side), and a jet flap effect which reduces the effective flow width at the impeller exit. Accordingly, the jet needs to have a circumferential velocity component in a direction of the impeller rotation and also a velocity component in a direction perpendicular to the casing wall surface.

As one example of the above means (2), Japanese Patent Laid-Open No. 39-13700 (1964) discloses a means in which a fluid is returned from the high-pressure stage side to the low-pressure stage side in an axial flow compressor to thereby suck a low-momentum fluid which is present inside the boundary layer along the casing wall at the high-pressure stage side, thereby stabilizing the flow. In this prior art, the return fluid supplied to the low-pressure stage acts in the form of a jet which provides momentum to the fluid in the vicinity of the wall surface, thereby also providing the same function as that of the above-mentioned means (1).

As one example of the means (3), Japanese Patent Laid-Open No. 56-167813 (1981) discloses an apparatus for preventing surging in a turbo-charger, in which air is injected from an opening facing tangentially to the direction of the impeller rotation at the impeller inlet portion. It is stated in this literature that the function of the injected air is to give prerotation to the flow so as to reduce an attack angle of the flow in relation to the blade, thereby preventing flow separation on the blade surface. Accordingly, the direction of the air injection is defined as being tangential in the direction of the impeller rotation. This means should provide prerotation over a relatively wide range of the blade height to prevent stall over a wide partial capacity range and, thus, it inevitably results in a reduction of the pressure head.

As one example of the means (4), UK Patent Application GB 2191606A discloses a means in which an unstable, fluctuating wave mode in the flow field is measured and, concurrently, the amplitude, phase, frequency, etc., of the wave mode are analyzed, and a vibrating blade, vibrating wall, an intermittent jet, etc., are used as an actuator to actively impart wave disturbance to the fluid which cancels the above-mentioned unstable wave mode, thereby preventing the occurrence of rotating stall, pressure surge, pressure pulsation, etc. This means is based on the assumption that there is an unstable wave mode as a precursor of rotating stall, pressure surge, etc., and hence cannot be applied to turbomachines in which such a wave mode is not present.

The present invention was made to eliminate the above-mentioned conventional drawbacks, and an object of the present invention is to provide a turbomachine in which the drawbacks of the conventional passive and active means can be eliminated and generation of a head-capacity curve having a positive slope can be prevented, thereby preventing the occurrence of stall.

SUMMARY OF THE INVENTION

In order to solve the above problems, according to a first aspect of the present invention, there is provided a turbomachine having an impeller rotating within a casing and circumferential or axial grooves or passages formed in a wall of the casing between an upstream portion and a downstream portion of the impeller, characterized by comprising a high pressure fluid injecting means for injecting high pressure fluid into the grooves or passages formed in the casing.

Further, according to a second aspect of the present invention, in the invention of the first aspect, the high pressure fluid injecting means includes an injection stopping means capable of permitting and inhibiting the injection of the high pressure fluid on demand.

Further, according to a third aspect of the present invention, in the invention of the first and second aspects, the high pressure fluid injecting means injects the high pressure fluid having a velocity component opposed to a direction of the impeller rotation into said grooves or passages formed in the casing.

Further, according to a fourth aspect of the present invention, in the invention of the first to third aspects, the high pressure fluid injecting means utilizes, as the high pressure fluid, high pressure fluid supplied from an outside pressure source or high pressure fluid supplied from a high pressure side of the turbomachine.

FIG. 19(*a*) is a sectional view showing the vicinity of an inlet portion of a turbomachine, and FIGS. 19(*b*) and 19(*c*) are sectional views of an impeller taken along the line 4—4 in FIG. 19(*a*). In the turbomachine of this kind, when the impeller 1 is rotated in a direction shown by the arrow 5, fluid flowing through an inlet of the turbomachine flows as shown by the solid line arrows a, b in FIG. 19(*b*). As a flow rate Q is decreased, the fluid flow shown by the arrow a, i.e., secondary flow is gradually directed toward a rotational direction ω of the impeller 1 in the vicinity of the casing 3. Finally, the flow is reversed toward the inlet side as shown by the solid line arrows c in FIG. 19(*c*), thereby causing an abrupt reduction in head as shown by a point B in FIG. 18.

To avoid this, in the present invention, as shown in FIG. 1, by injecting jets 6 of high pressure fluid into grooves 4 formed in the casing 3 toward a direction opposite to the rotational direction ω of the impeller 1, a fluid flow shown by the broken lines in FIG. 19 is induced along an inner wall of the casing 3. This fluid flow is counter to the fluid flow shown by the arrows a which are apt to flow toward a rotational direction ω as the flow rate Q is decreased. Thus, it is possible to suppress the growth of the fluid flow tending to reverse toward the inlet side (as shown by the arrows c) to thereby delay or suppress generation of an unstable positive-slope characteristic of the head-capacity curve as shown by the dot-dash line D or the two-dot-dash line E in FIG. 18. Incidentally, in the case where the grooves 4 alone are formed in the casing 3 and jets 6 are not injected, the head-capacity curve becomes as shown by the broken line C in FIG. 18.

The casing treatment configuration (configuration of the grooves 4) provided in the inner wall of the casing 3 may be, for example, any one of the shapes shown in FIGS. 1 to 3.

A pressure difference is generated between a pressure side 39 and a suction side 33 of the blades of the rotating impeller 1 in FIG. 1. Accordingly, even in the conventional arrangements in which the grooves 4 alone are formed in the inner wall of the casing 3 along the circumferential direction and a means for injecting the jets 6 is not provided, due to the pressure difference between the pressure side 39 and the suction side 33 of the blades of the rotating impeller 1, there arises a leakage flow which passes through the grooves 4 and flows in a direction counter to the rotational direction ω of the impeller 1. However, since such a leakage flow is essentially generated only in the vicinity of the blade tips and the pressure difference is relatively small, a speed of the flow is relatively slow and, therefore, is insufficient to adequately suppress the fluid flow (as shown by the arrows c, FIG. 19(*c*)) processing toward the inlet of the impeller. Accordingly, the conventional arrangements in which the circumferential grooves 4 alone are formed in the inner wall of the casing 3, FIG. 2, have a disadvantage that the stall margin cannot be sufficiently improved. To the contrary, the conventional arrangements of the circumferential grooves 4 have an advantage that efficiency reduction in design point is low, since an amount of the leakage flow passing through the grooves 4 to the suction surface side 33, FIG. 1(*c*), is small.

In the conventional arrangement, as shown in FIG. 3, in which the axial grooves 4 alone are formed in the inner wall of the casing 3 and the means for injecting the jets 6 is not provided, since a leakage of fluid is caused by a pressure difference between the outlet side and the inlet side of the impeller, the amount of the leakage in the axial grooves is greater than that in the circumferential grooves, and a fluid flow has a faster circumferential velocity component due to the inclination of the grooves 4 in the circumferential direction as shown in FIG. 3(*b*). Thus, this conventional arrangement has an advantage that the improvement of the stall margin is greater than that in the circumferential grooves. However, this arrangement also has a disadvantage that leakage of fluid is great and, therefore, the efficiency reduction in design point is also great.

In comparison with the above-mentioned conventional arrangements, according to the present invention, since the high pressure fluid jets 6 are injected from nozzles 5 into the grooves 4 formed in the inner wall of the casing 3 along the circumferential direction to thereby actively generate the circumferential flow, the stall margin can be improved significantly. At the same time, since the injection of the high pressure fluid jets 6 can be interrupted or stopped at the design flow rate, the efficiency reduction in design point can be avoided or minimized.

Further, as shown in FIG. 3, when the present invention is applied to the axial grooves 4 formed in the inner wall of the casing 3 to inject the jets 6 into the grooves, the stall margin can be further improved in a partial capacity range while maintaining the same efficiency reduction in design point as that of the conventional casing treatment having axial grooves alone, by interrupting the jet injection.

The above and other objects, features and advantages of the present invention will become more apparent from the following description when taken in conjunction with the accompanying drawings in which preferred embodiments of the present invention are shown by way of illustrative examples.

PREFERRED EMBODIMENT OF THE INVENTION

Figure 1A:
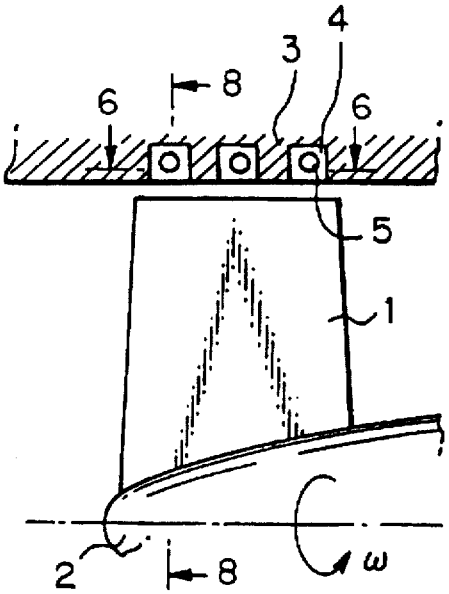
FIG. 1 shows the vicinity of an inlet portion of a turbomachine according to a preferred embodiment of the present invention, where FIG. 1(*a*) is a partial longitudinal sectional view, FIG. 1(*b*) is a sectional view taken along the line 6—6 in FIG. 1(*a*), and FIG. 1(*c*) is a sectional view taken along the line B—B in FIG. 1(*a*)
Figure 1B:
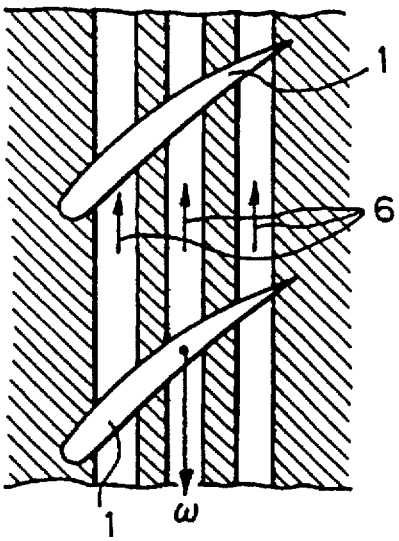
Figure 1C:
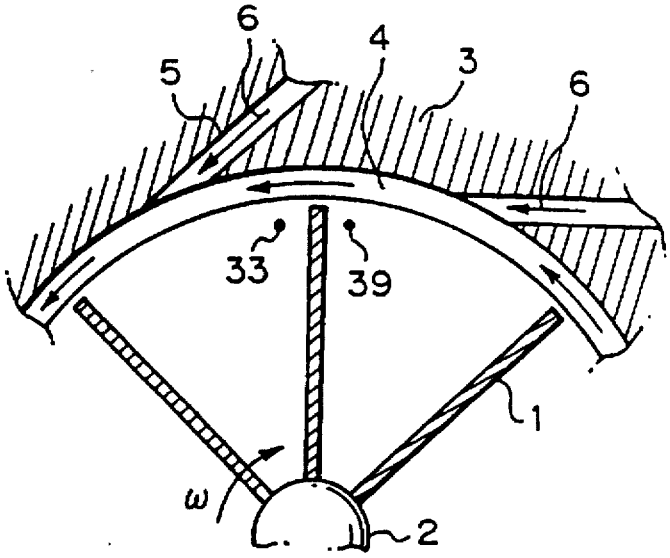

The present invention will now be explained in connection with embodiments thereof with reference to the accompanying drawings. FIG. 1 shows the vicinity of an inlet portion of a turbomachine according to a preferred embodiment of the present invention, where FIG. 1(*a*) is a partial longitudinal sectional view, FIG. 1(*b*) is a sectional view taken along the line 6—6, and FIG. 1(*c*) is a sectional view taken along the line 8—8. In FIG. 1, an impeller 1 is attached to a rotating shaft 2 and is rotated around the axis of the shaft 2 in a direction shown by the arrow ω.

A plurality of grooves (casing treatment) 4 is formed in an inner wall of a casing 3 in a circumferential direction, and tip ends of nozzles 5 are open to bottoms of the corresponding grooves 4 so that jets 6 of high pressure fluid are injected into the grooves 4 in a direction tangential to the bottom of each groove 4 and counter to a rotational direction of the impeller 1. Several nozzles 5 are provided at circumferentially spaced points for each groove 4.

Figure 19A:
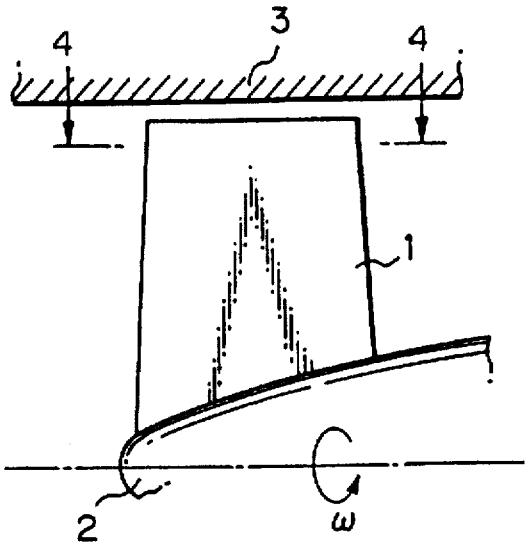
FIG. 19 is a view showing the vicinity of an inlet portion of a turbomachine, where FIG. 19(*a*) is a longitudinal sectional view, FIGS. 19(*b*) and 19(*c*) respectively are sectional view taken along the line 4—4 in FIG. 19(*a*).
Figure 19B:
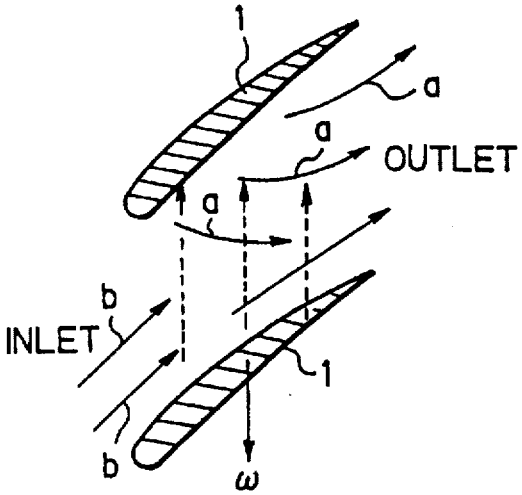
Figure 19C:
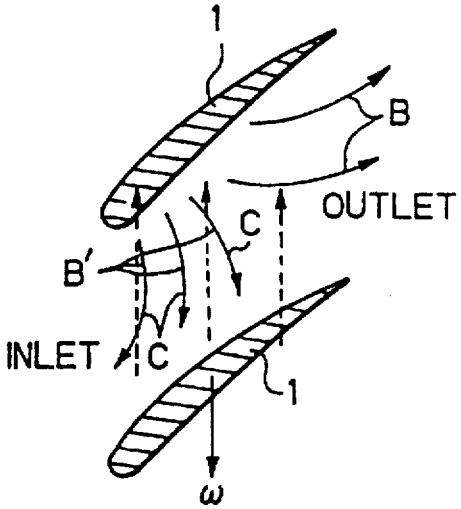

By injecting the high pressure fluid jets 6 from the nozzles 5, a flow changing its direction to the rotational direction ω of the impeller 1 due to the secondary flow in the vicinity of the casing 3 upon reduction of the flow rate Q as mentioned above, is forced to flow in a direction counter to the impeller rotation along the inner wall of the casing 3 (see the dotted arrow in FIG. 19), thereby suppressing generation of a back flow directing toward the inlet to thereby prevent the abrupt reduction in head due to the generation of the back flow.

Figure 2:
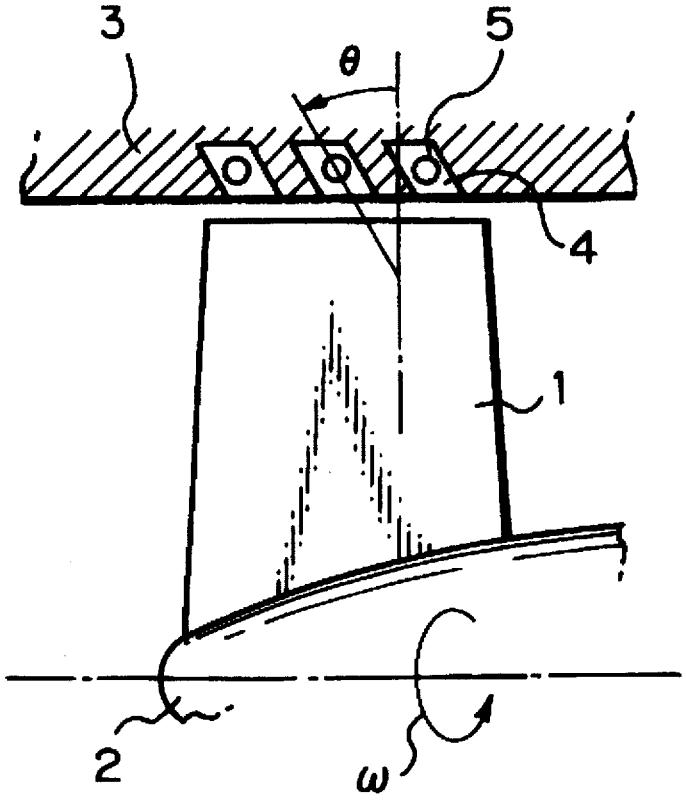
FIG. 2 is a sectional view showing the vicinity of an inlet portion of a turbomachine according to another embodiment of the present invention.

FIG. 2 shows the vicinity of an inlet portion of a turbomachine according to another embodiment of the present invention. Unlike the turbomachine shown in FIG. 1, in a turbomachine according to this embodiment, the circumferential grooves 4 are skewed axially at an angle of θ with respect to the radial direction. By introducing skew for the circumferential grooves 4 in this way, since the velocity component directing toward the direction shown by the arrow b in FIG. 19(*b*) is provided, the flow shown by the arrow a is prevented from being changed its direction toward the direction shown by the arrow c in FIG. 19(*c*), thereby effectively preventing the generation of a back flow toward the inlet.

Figure 3A:
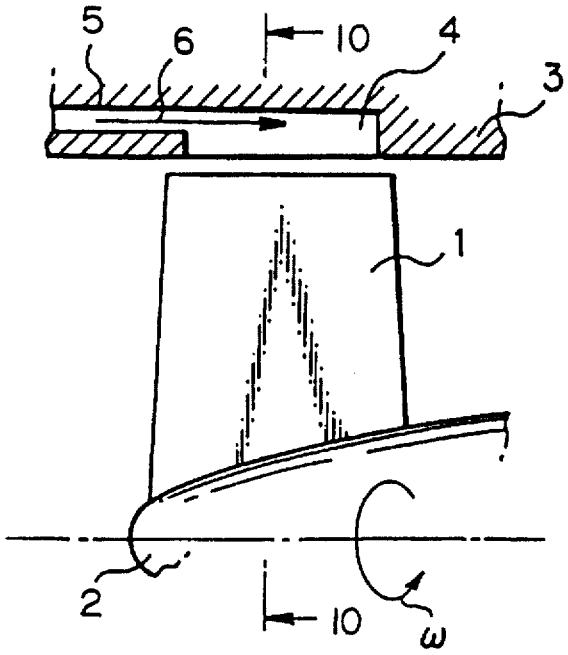
FIG. 3 shows the vicinity of an inlet portion of a turbomachine according to a further embodiment of the present invention, where FIG. 3(*a*) is a partial longitudinal sectional view and FIG. 3(*b*) is a sectional view taken along the line 10—10 in FIG. 3(*a*)
Figure 3B:
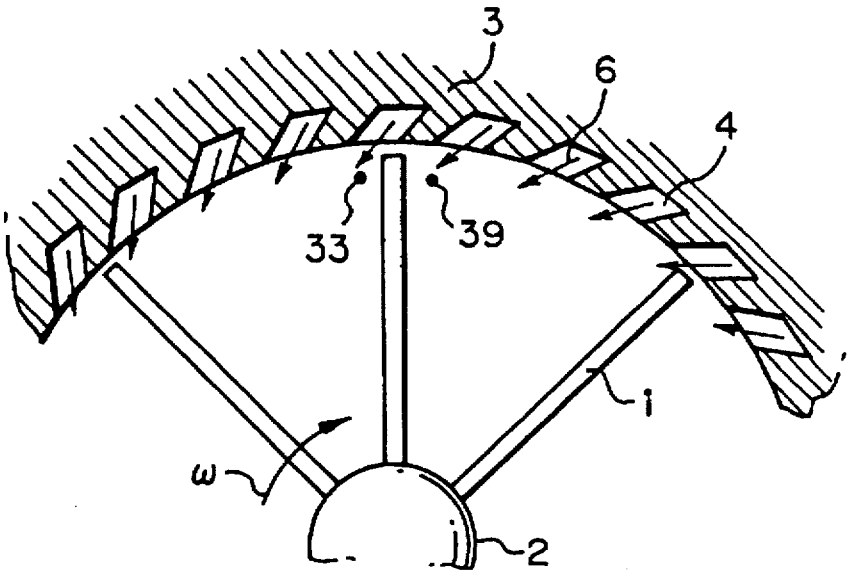

FIG. 3 shows the vicinity of an inlet portion of a turbomachine according to a further embodiment of the present invention, where FIG. 3(*a*) is a partial longitudinal sectional view and FIG. 3(*b*) is a sectional view taken along the line 10—10, FIG. 3(*a*). In the turbomachine according to this embodiment, grooves 4 formed in the inner surface of the casing 3 extend along an axial direction, and, as shown in FIG. 3(*b*), the grooves are skewed in a circumferential direction so that the jets 6 are directed toward a direction counter to the direction of the impeller rotation. Further, a means for injecting the high pressure fluid jets 6 into the grooves 4 is provided. As mentioned above, in the casing treatment in which the axial grooves are skewed in the circumferential direction, it is known that, although the reduction in peak efficiency is great, the improvement of the stall margin can be greatly enhanced. In the present invention, by further injecting the high pressure fluid jets 6 into the grooves 4, since a flow having the greater circumferential velocity component flows out of each groove 4, the stall margin can be further improved.

Although not shown, the means for ejecting the high pressure fluid jets 6 from the nozzles 5 may include a valve and a pump to permit and inhibit the injection of the jets 6 on demand (for example, the injection is effected at stall flow rate or thereabout).

Figure 6:
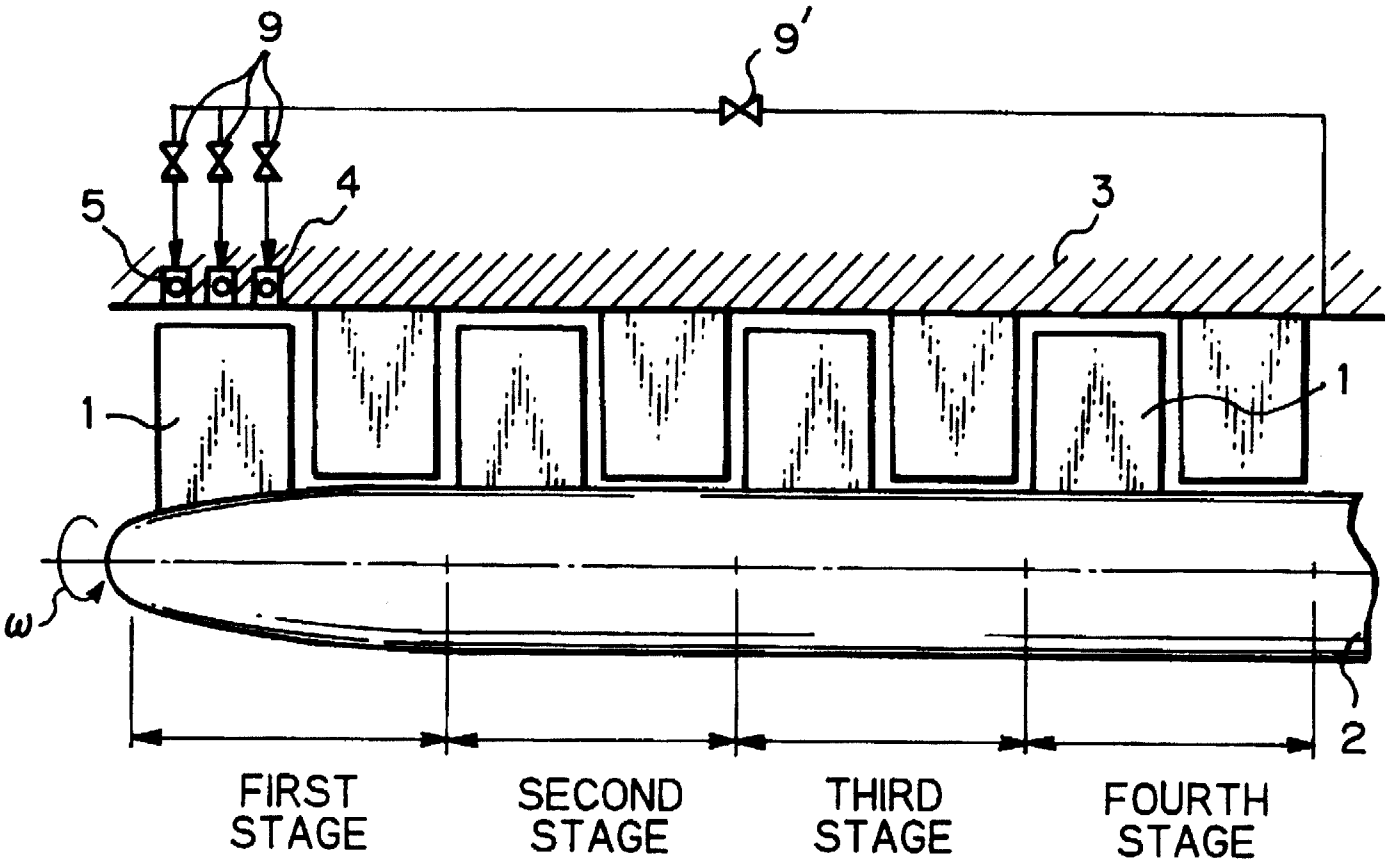
FIG. 6 is a longitudinal sectional view showing an embodiment in which the present invention is applied to a multi-stage turbomachine.

The jet injection stopping means may be provided one for each nozzle or in a line supplying a high pressure fluid to the nozzles (see FIG. 6).

Figure 4A:
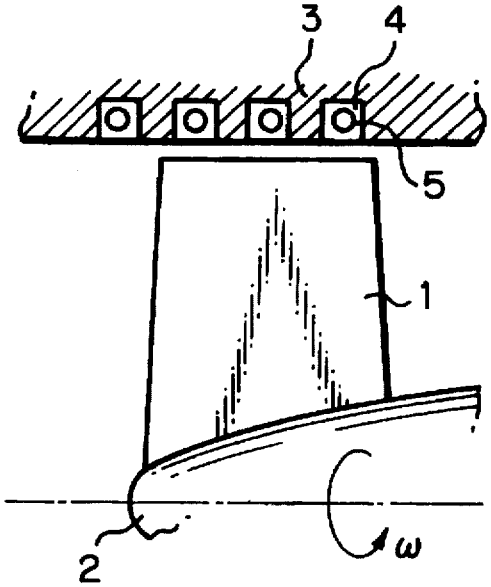
FIG. 4 shows the vicinity of an inlet portion of turbomachines according to further embodiments of the present invention, where FIG. 4(*a*) is a partial longitudinal sectional view of a modified embodiment of FIG. 1 and FIG. 4(*b*) is a partial longitudinal sectional view of a modified embodiment of FIG. 3.
Figure 4B:
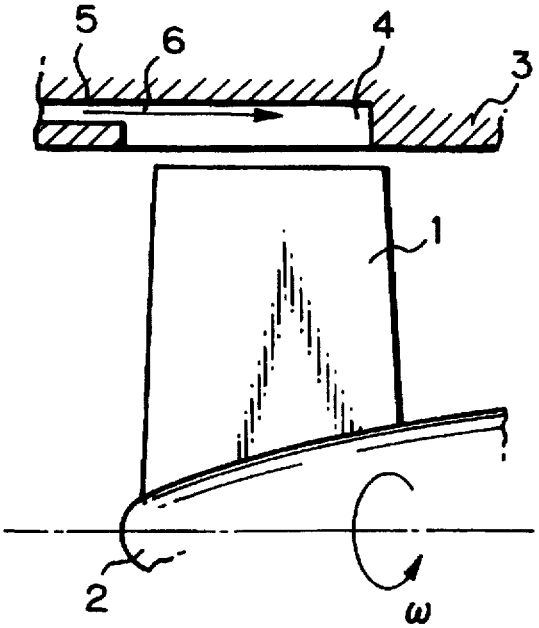

FIGS. 4(*a*) and 4(*b*) respectively show a modified embodiment of FIGS. 1 and 3. In these embodiments, the grooves 4 are positioned or extended just beyond the range of the impeller 1 on the upstream thereof. The grooves 4 may be positioned or extended just beyond the range of the impeller on the downstream thereof. Even though the grooves are positioned or extended just beyond the impeller to the upstream and/or downstream thereof, advantages similar to those given in the embodiment of FIGS. 1 and 3 can be obtained.

Figure 5A:
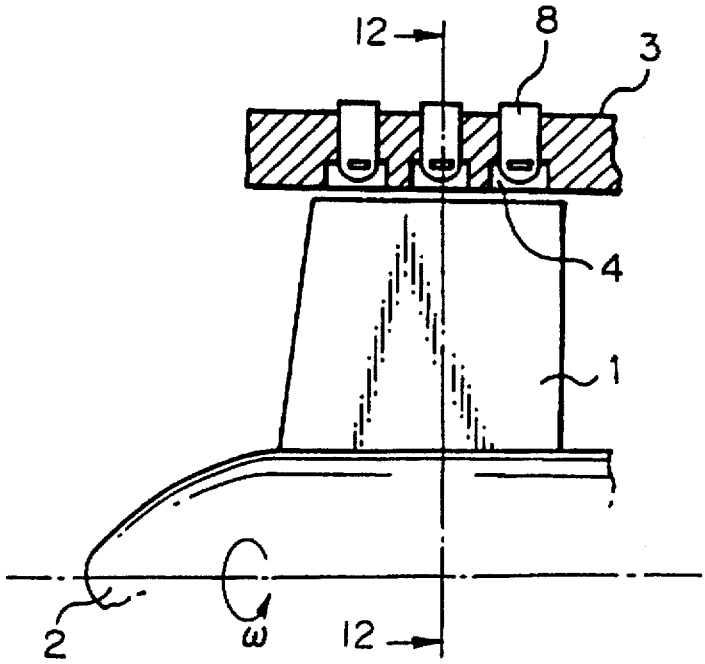
FIG. 5 shows the vicinity of an inlet portion of a turbomachine according to a still further embodiment of the present invention, where FIG. 5(*a*) is a partial longitudinal sectional view and FIG. 5(*b*) is a sectional view taken along the line 12—12 in FIG. 5(*a*)
Figure 5B:
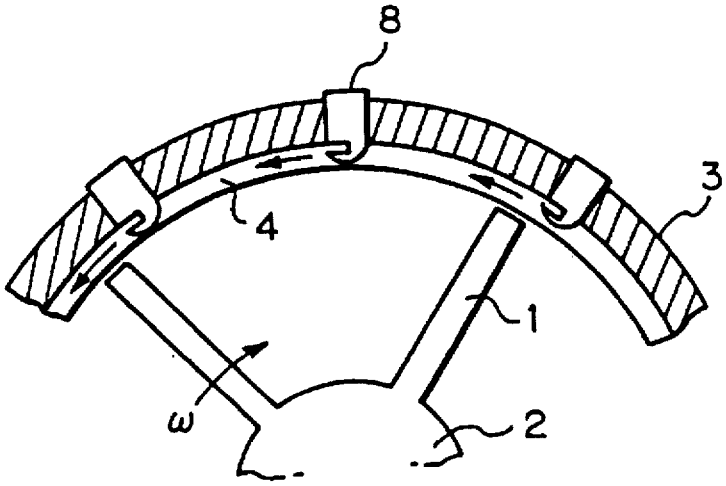

FIG. 5 is another modified embodiment of FIG. 1, wherein nozzles 8 are formed independently from the casing 3 and fixed to the casing so that nozzle jet opening at the tip ends thereof are positioned within the grooves 4 facing a direction tangential to the grooves. By this arrangement, manufacture of the nozzle is made simple and inexpensive and it is easy to adjust the direction of the fluid ejection.

FIG. 6 is a longitudinal sectional view showing an embodiment in which the arrangement shown in FIG. 1 is applied to a multi-stage turbomachine. In this multi-stage turbomachine, a high pressure fluid is supplied from a downstream high pressure stage side to an upstream low pressure stage side, and the high pressure fluid is injected from the nozzles 5 into the grooves 4 as jets. With this arrangement, there is no need to provide an external high pressure fluid generating means.

In FIG. 6, the reference numerals 9 and 9' show a valve as a jet injection stopping means which permit and inhibit the injection of the jets 6 on demand. The jet injection stopping means may be provided one for each nozzle 5 or in a conduit supplying a high pressure fluid to the nozzles 5 as shown. Although, in the embodiment shown, the grooves 4 are provided in the first stage corresponding to the impeller 1, the grooves may be provided in the second stage, third stage or all stages of the turbomachine.

Figure 7:
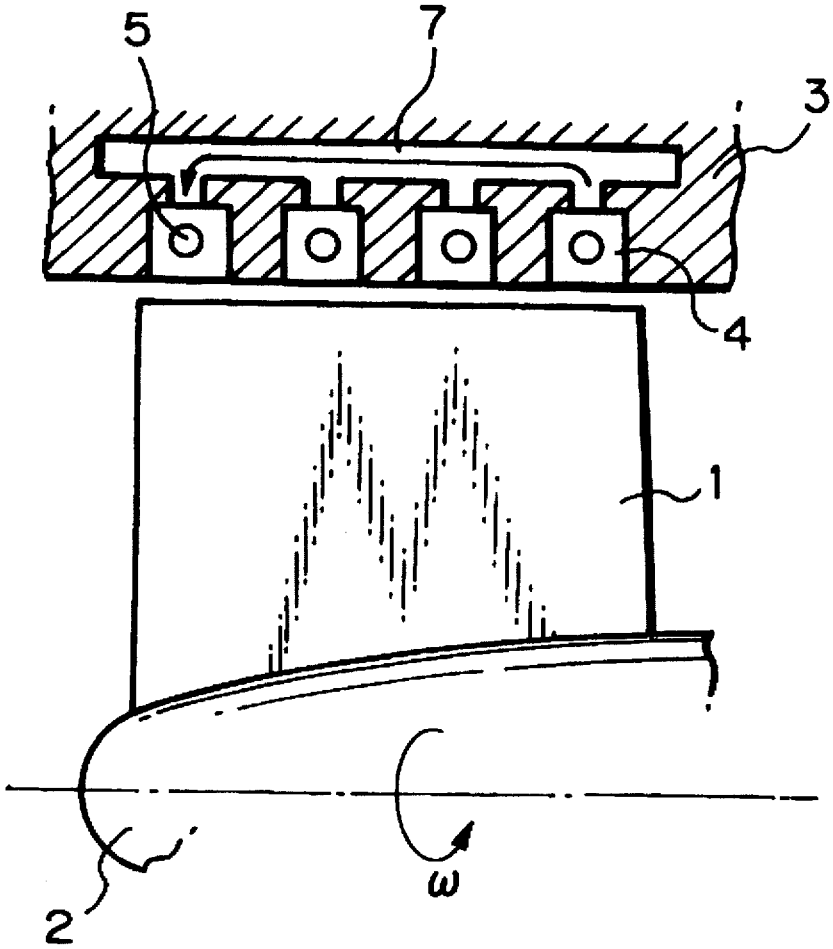
FIG. 7 is a sectional view showing the vicinity of an inlet portion of a turbomachine according to a still further embodiment of the present invention.

FIG. 7 shows the vicinity of an inlet portion of a turbomachine according to a still further embodiment of the present invention. In the turbomachine according to this embodiment, as shown, there is provided an axially extending chamber 7 for interconnecting the circumferential grooves 4 to each other, and, high pressure fluid on the downstream is introduced into the upstream grooves 4 through the chamber 7 in order to eject the high pressure fluid from the nozzles 5 as jets.

By interconnecting the grooves 4 by the chamber 7, the stall margin improvement is further enhanced as will be explained hereinafter.

Next, experimental results of the invention will be explained comparing them with those of the conventional casing treatment.

Figure 9B:
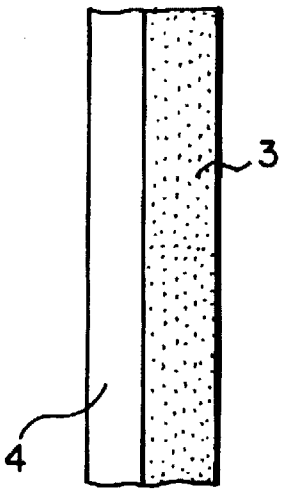
FIG. 9 is a view showing a conventional casing treatment of a circumferential groove type, where FIG. 9(*a*) is an internal view of a casing and FIG. 9(*b*) is a sectional view taken along line 16—16 in FIG. 9(*a*)
Figure 9A:
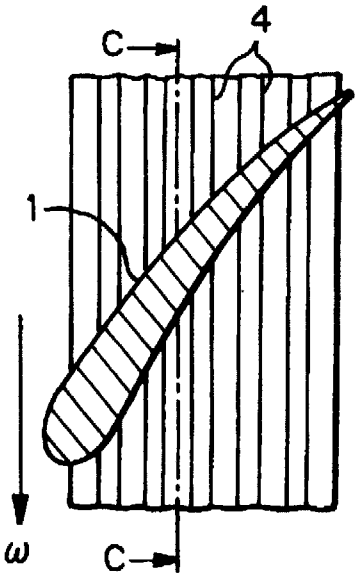
Figure 8B:
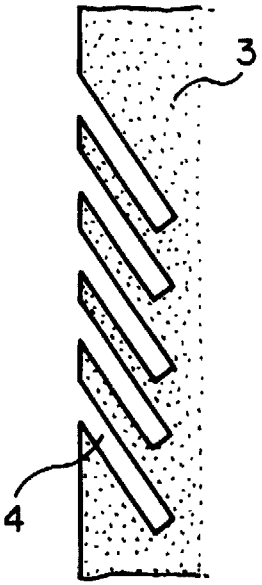
FIG. 8 is a view showing a conventional casing treatment of an axial skewed slot type, where FIG. 8(*a*) is an internal view of a casing and FIG. 8(*b*) is a sectional view taken along line 14—14 in FIG. 8(*a*)
Figure 8A:
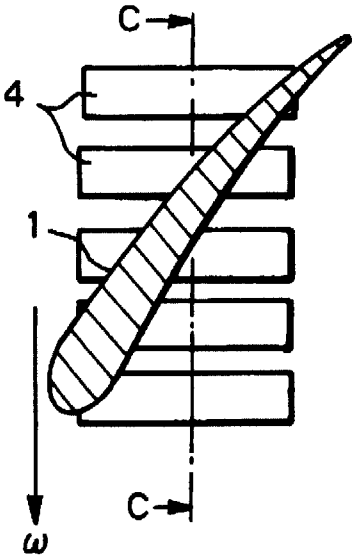

FIGS. 8 and 9 respectively show a conventional casing treatment of an axial skewed slot type and a casing treatment of a circumferential groove type applied to a casing of an axial flow compressor.

Figure 10:
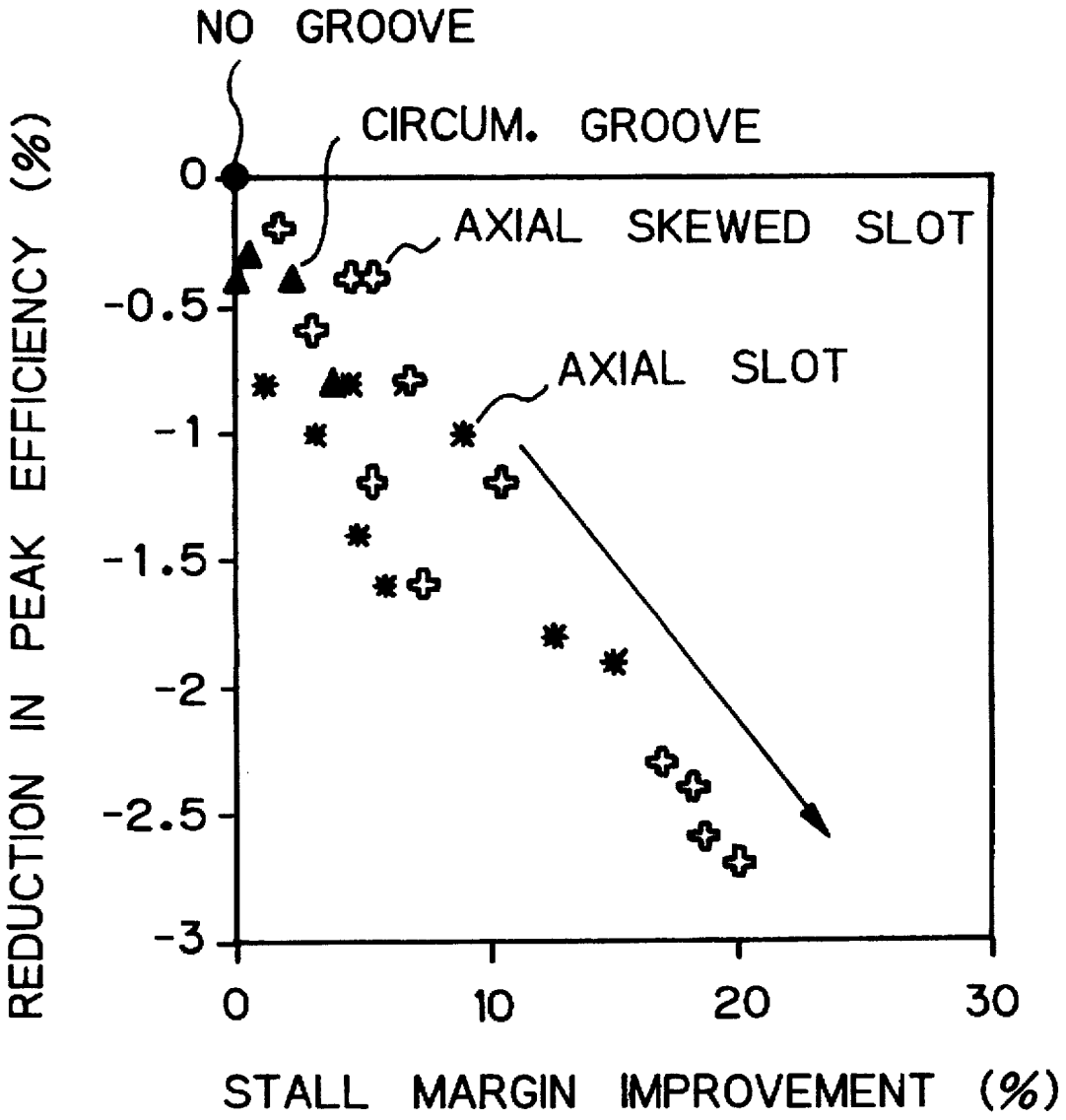
FIG. 10 is a graph showing the correlation between a stall margin improvement and a reduction in peak efficiency for different types of conventional casing treatment.

FIG. 10 shows the correlation between the stall margin improvement and the reduction in peak efficiency for the conventional casing treatment wherein the stall margin improvement is varied by changing the size, configuration, number, etc., of the grooves. FIG. 10 includes the test results of a so-called axial slot type casing treatment, wherein slots or grooves 4 in FIG. 8 are not inclined to the circumferential direction, in addition to the test results of the casing treatment shown in FIGS. 8 and 9.

As is clear from FIG. 10, in the conventional casing treatment, when the stall margin improvement is increased, the reduction in peak efficiency is inevitably increased in any of the circumferential groove, axial skewed slot or axial slot type casing treatments (tendency is shown by a thick arrow). As mentioned hereinabove, in an axial skewed slot type casing treatment, although a great stall margin improvement can be obtained, the reduction in peak efficiency is also great. In a circumferential groove type casing treatment, although the reduction in peak efficiency is small, the stall margin improvement is also small. Thus, in the conventional casing treatment, it is impossible to increase the stall margin improvement while suppressing the reduction in peak efficiency.

Figure 11A:
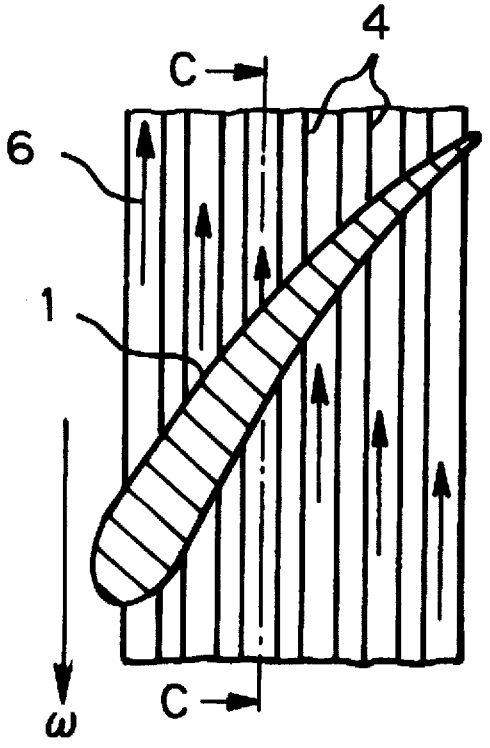
FIG. 11 is a view showing a casing treatment of a circumferential groove type with jet injection according to an embodiment of the present invention, where FIG. 11(*a*) is an internal view of a casing and FIG. 11(*b*) is a sectional view taken along line 18—18 in FIG. 11(*a*)
Figure 11B:
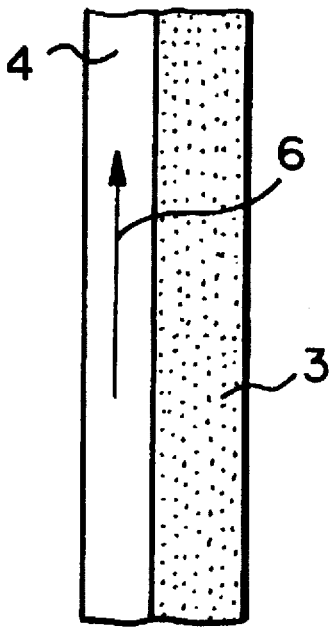

FIG. 11 shows an example of the casing treatment of the present invention used in the experiment, wherein six circumferential grooves 4 are provided in an inner wall of the casing of an axial flow fan and high pressure fluid (air) is injected in each of the grooves in a direction counter to the rotational direction of the impeller 1.

Figure 12:
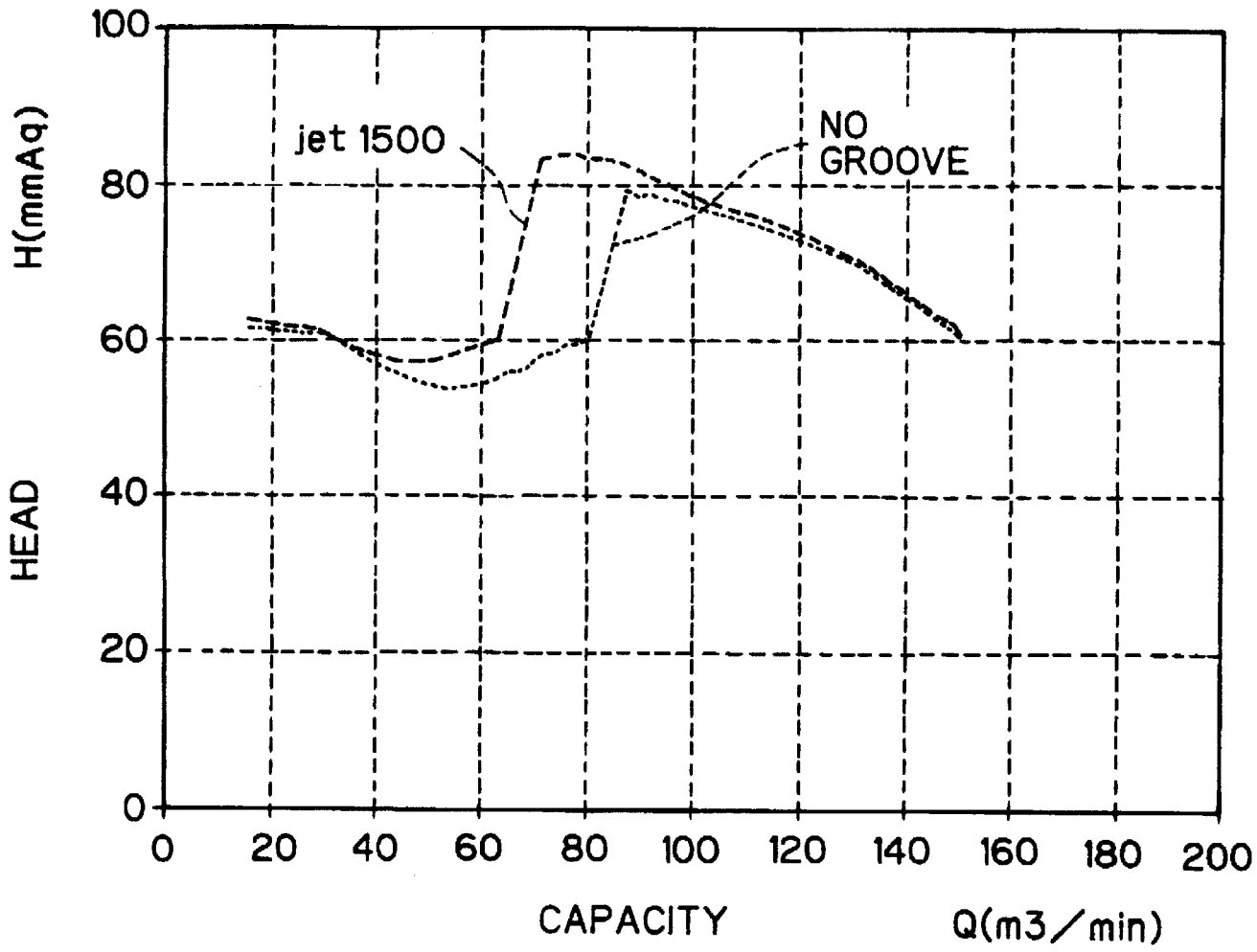
FIG. 12 is a graph showing head-capacity curve of an axial flow fan having a casing treatment of a circumferential groove type with jet injection according to the present invention.

FIG. 12 is a graph showing the effect of the casing treatment with jet injection of the present invention, wherein a head-capacity curve of an axial flow fan without a casing treatment (no groove) and a head-capacity curve of the casing treatment of the above-mentioned example wherein high pressure fluid is injected into each of the six circumferential grooves (jet 1500) are shown. The total flow rate of the air injected into grooves relative to the design flow rate is about 1%. As is clear from the drawing, the stall margin improvement is remarkably increased by injecting high pressure fluid into the grooves in the casing treatment of the invention.

Figure 13A:
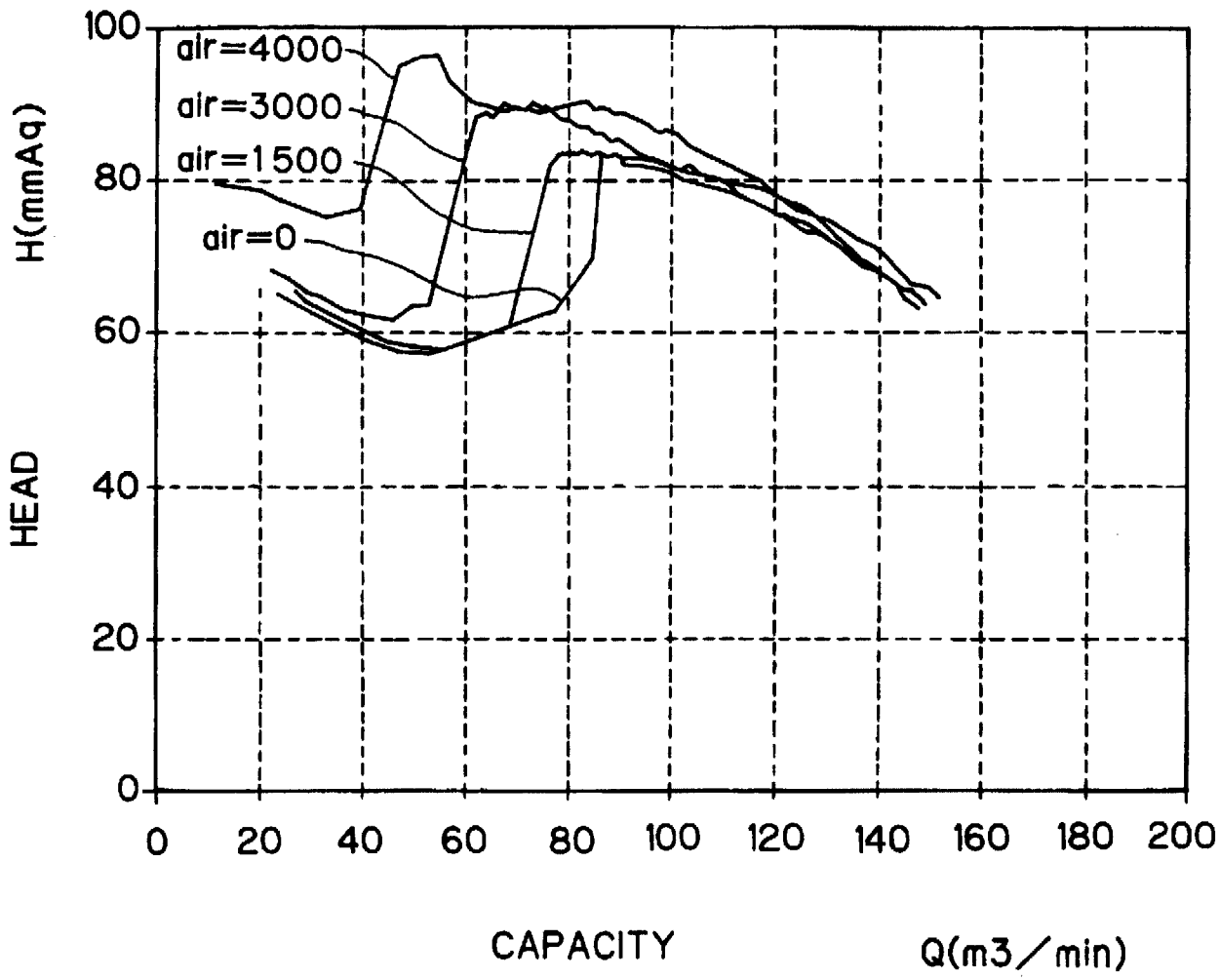
FIG. 13(*a*) is a graph showing change in head-capacity curve of an axial flow fan when a flow rate of the jet injection is varied in a casing treatment of the present invention and FIG. 13(*b*) is a view showing the casing treatment used in the experiment.
Figure 13B:
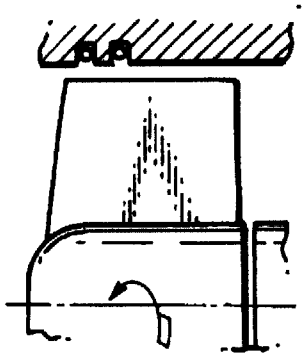

FIG. 13 shows the change in stall margin improvement when the flow rate of the injected high pressure fluid (air) is varied. The casing treatment used in the experiment includes two circumferential grooves positioned on the impeller inlet side as shown in FIG. 13(*b*) and head-capacity curves are obtained when the flow rate of the high pressure fluid injected into the two circumferential grooves are varied. In FIG. 13(*a*), the curve air=0 denotes a head-capacity curve where no high pressure fluid is injected into the grooves, the curve air=1500 denotes a head-capacity curve where a high pressure fluid of about 1.0% of the design flow rate is injected into the grooves, the curve air=3000 denotes a head-capacity curve where a high pressure fluid of about 2.0% of the design flow rate is injected into the grooves and the curve air=4000 denotes a head-capacity curve where a high pressure fluid of about 2.7% of the design flow rate is injected into the grooves in the direction counter to the rotational direction of the impeller, respectively.

As is clear from FIG. 13, when the flow rate of the injected high pressure fluid is increased, the stall margin improvement is increased accordingly. Incidentally, a depression is seen in the curve air=4000 in FIG. 13. This depression seems to be caused by an irregular flow of a high pressure fluid which does not follow the bottom surface of the grooves, but would be dissolved by increasing the number of jet injection points along the grooves and thereby equalizing the jet flow circumferentially along the grooves.

Figure 14A:
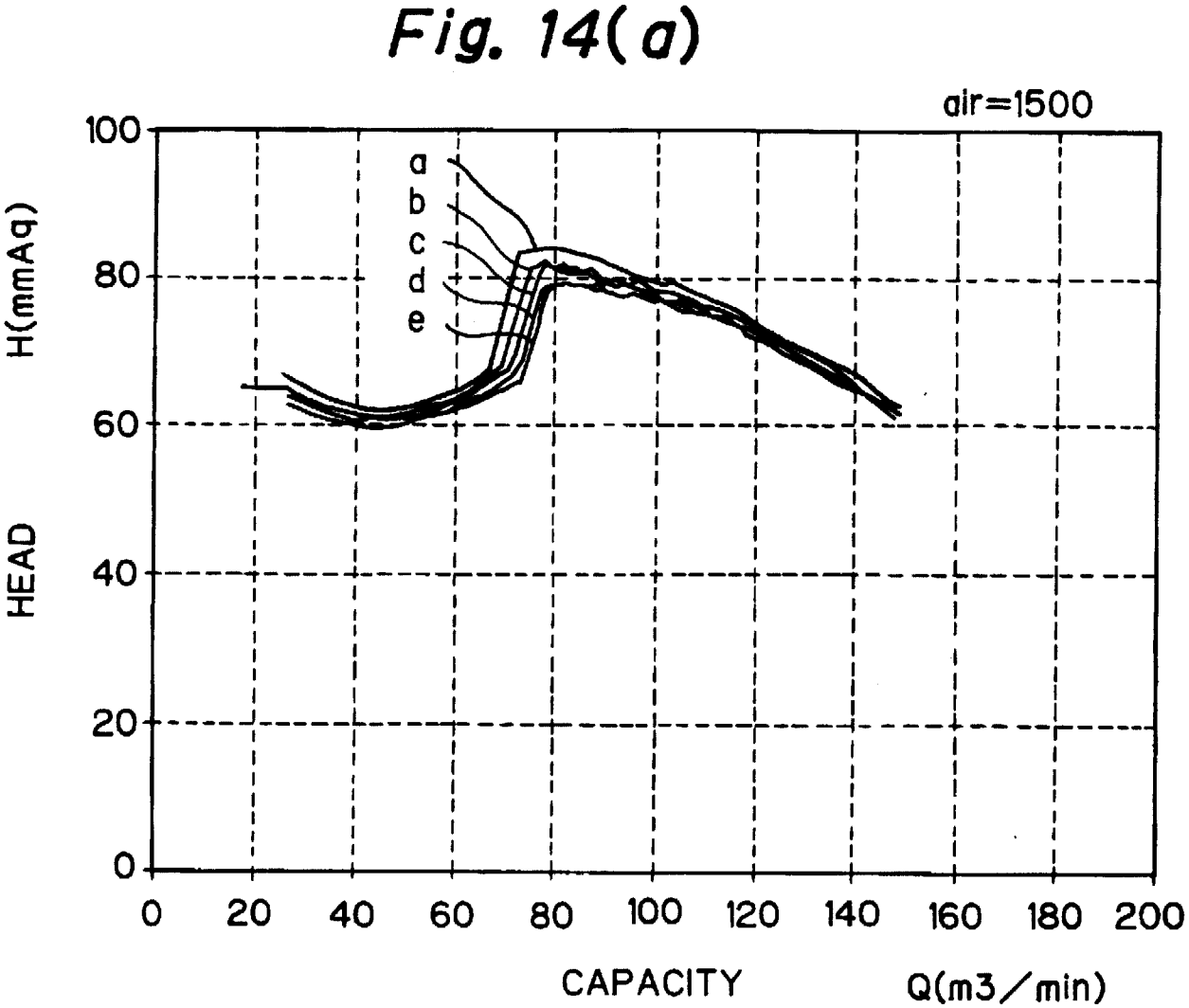
FIG. 14(*a*) is a graph showing change in head-capacity curve of an axial flow fan when the position of the jet injection is varied in a casing treatment of the present invention and FIG. 14(*b*) is a view showing the casing treatment used in the experiment.
Figure 14B:
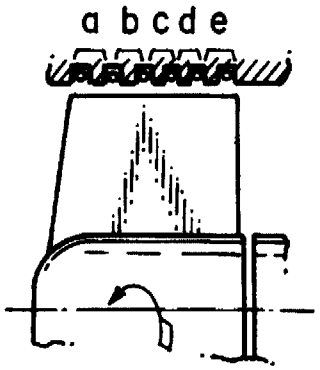

FIG. 14 is a graph showing the change in stall margin improvement when the injection location of the high pressure fluid is varied. The casing treatment used in the test is shown in FIG. 14(*b*), wherein two circumferential grooves are provided on the inner wall of the casing and the head-capacity curves are obtained when the location of the two circumferential grooves are shifted from the impeller inlet side to the outlet side as shown in a, b, c, d, and e in the drawing. As is clear from FIG. 14, the stall margin improvement is greater when the high pressure fluid is injected on the impeller inlet side than it is injected on the impeller outlet side. Therefore, even if the number of the grooves is reduced, a sufficient stall margin improvement could be obtained by providing them on the impeller inlet side. Then it is possible to reduce the manufacturing cost by decreasing the number of the grooves.

Figure 15:
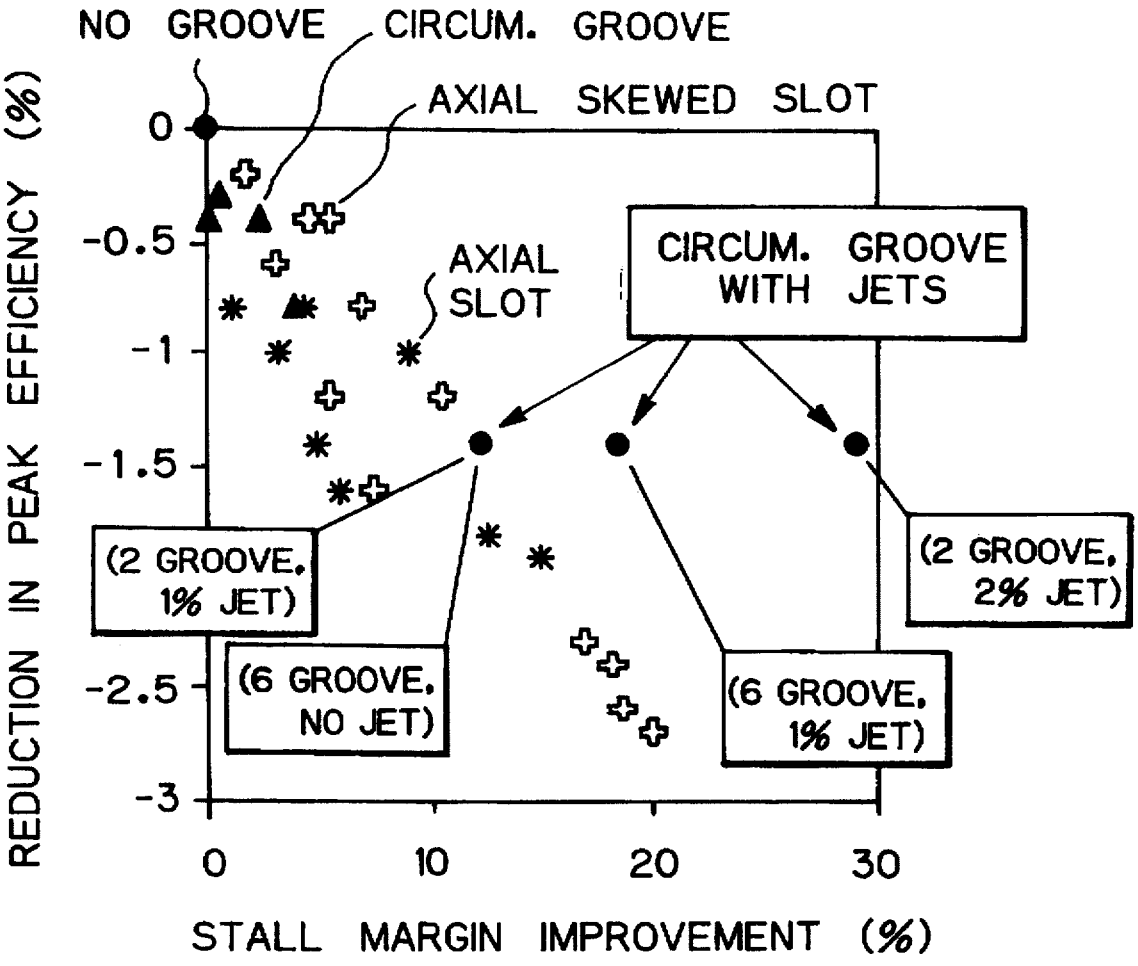
FIG. 15 is a graph showing the correlation between a stall margin improvement and a reduction in peak efficiency of a casing treatment of the present invention together with known data for conventional casing treatment.

FIG. 15 is a graph showing the test results of the casing treatment with the jet injection of the present invention and for the purposes of comparison it is shown together with the conventional test results shown in FIG. 10. In FIG. 15, "2 grooves 1% jet" denotes the case where a high pressure fluid (air) of about 1% of the design flow rate is injected into the two circumferential grooves of the casing treatment, "6 grooves no jet" denotes the case where no high pressure fluid is injected into the six circumferential grooves of the casing treatment, "6 grooves 1.0% jet" denotes the case where the high pressure fluid of about 1.0% of the design flow rate is injected into six circumferential grooves of the casing treatment, and "2 grooves 2% jet" denotes the case where a high pressure fluid of about 2.0% of the design flow rate is injected into two circumferential grooves of the casing treatment.

As is clear from FIG. 15, when a casing treatment of the invention is used, the stall margin improvement can be increased without increasing the reduction in peak efficiency and a great stall margin improvement can be obtained even with the small number of grooves. From the graph, it will be understood that even when the number of circumferential grooves is two in this invention, it is possible to obtain a stall margin improvement which is greater than that of the conventional casing treatment having six circumferential grooves by increasing the flow rate of the injected high pressure fluid.

Figure 16:
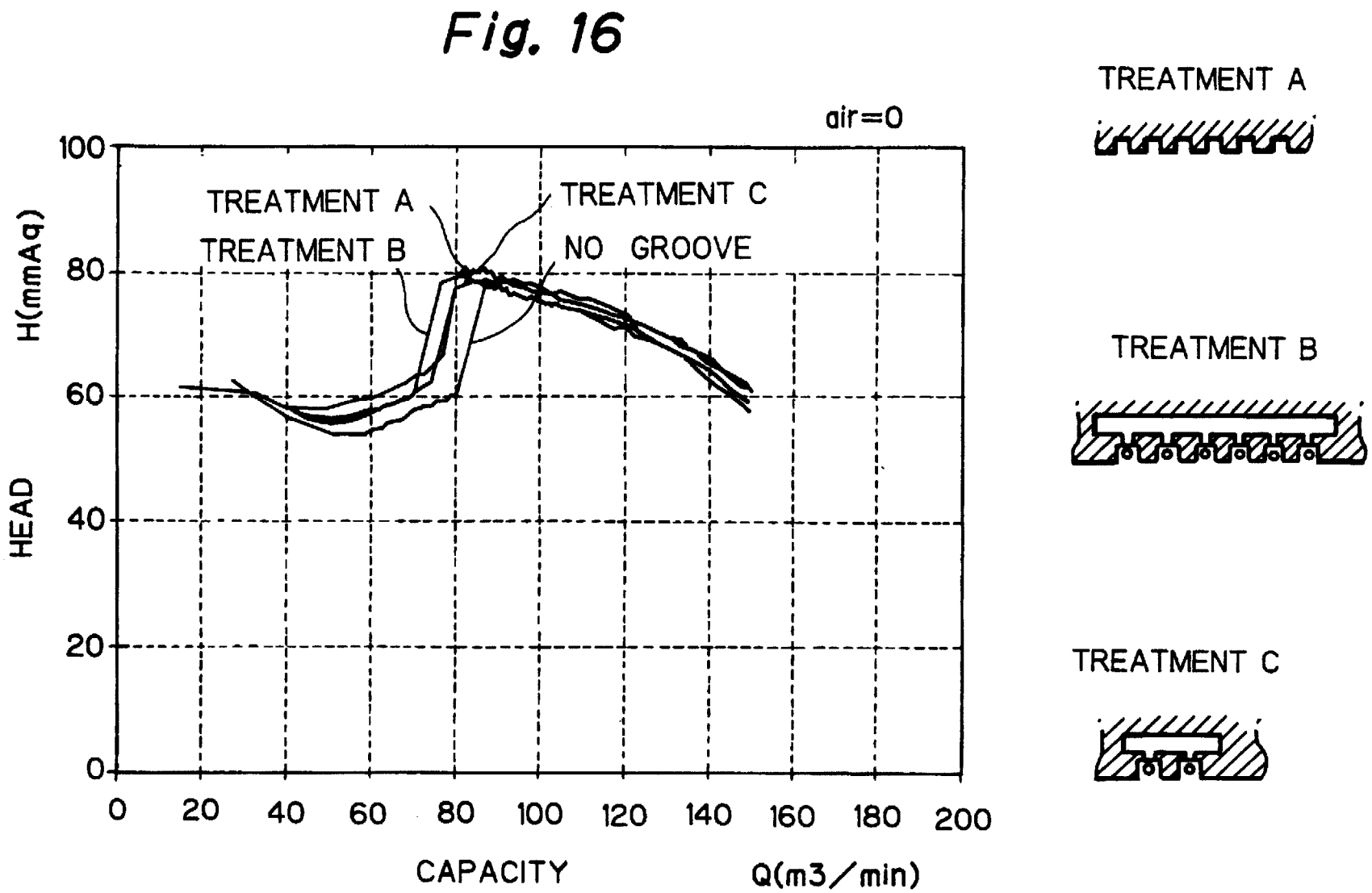
FIG. 16 is a graph showing change in head-capacity curve of an axial flow fan when grooves in a casing treatment are interconnected by a chamber.
Figure 17A:
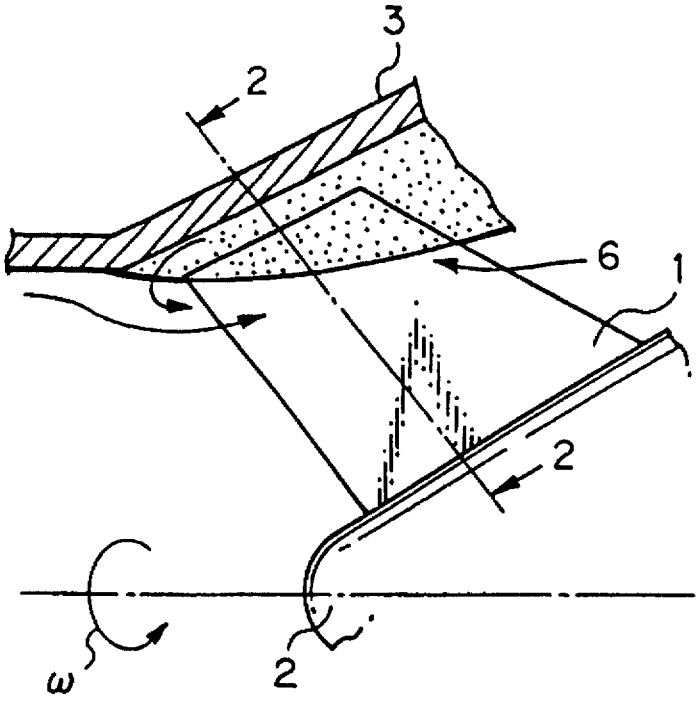
Fig. 17(a) PRIOR ART
FIG. 17 is a view showing the vicinity of an inlet portion of a conventional turbomachine, where FIG. 17(*a*) is a longitudinal sectional view and FIG. 17(*b*) is a sectional view of an impeller taken along the line 2—2 in FIG. 17(*a*)
Figure 17B:
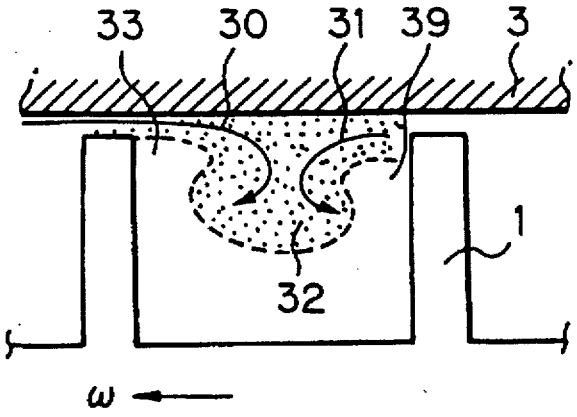
Fig. 17(b) PRIOR ART
Figure 18:
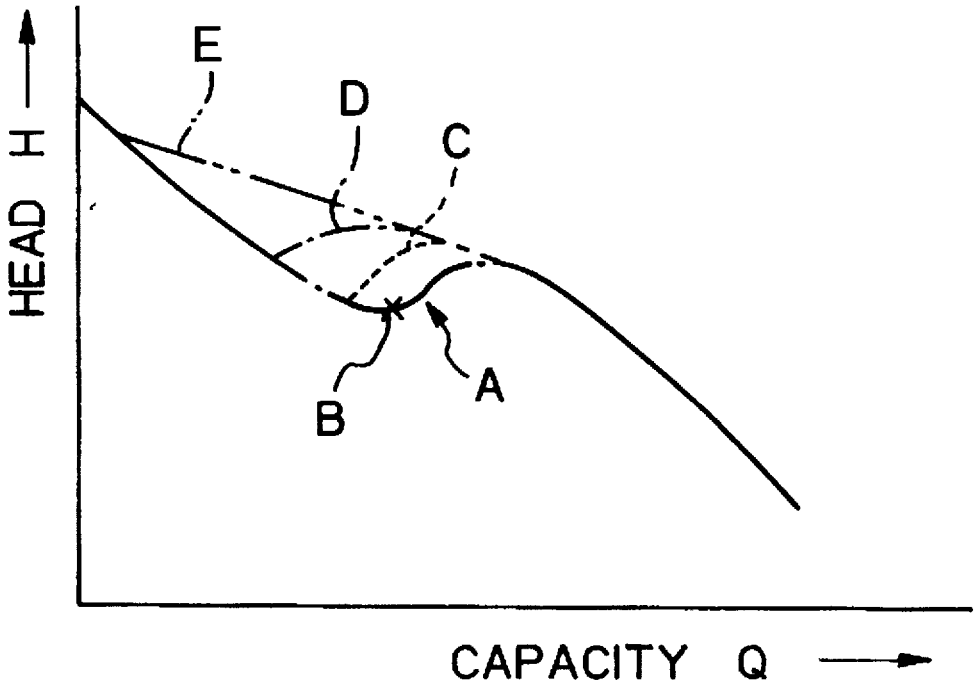
FIG. 18 is a graph showing a head-capacity curve of the turbomachine.

FIG. 16 is a graph showing the effects of interconnecting the grooves of the casing treatment by a chamber. In FIG. 16, the curve "no groove" denotes a head-capacity curve where no casing treatment is provided on the casing inner wall, the curve "treatment A" denotes a head-capacity curve where a conventional six circumferential grooves alone are provided on the casing inner wall as shown in treatment A, the curve "treatment B" denotes a head-capacity curve where the conventional six circumferential grooves are interconnected by a chamber as shown in treatment B, and the curve "treatment C" denotes a head-capacity curve where two circumferential grooves are interconnected by a chamber as shown in treatment C.

As will be clear from FIG. 16, even when the high pressure fluid is not injected into the grooves, the stall margin improvement can be increased by interconnecting the grooves by a chamber. In addition, it will be understood that even when the number of grooves is two, by interconnecting them by a chamber, it is possible to obtain a stall margin improvement which almost corresponds to that obtained in the six circumferential grooves. Therefore, it is possible to obtain still greater stall margin improvement by combining the effect of interconnecting the grooves by a chamber with the effect of injecting a high pressure fluid into the grooves.

As mentioned above, according to the present invention, since the high pressure fluid is injected into the circumferential or axial grooves or passages formed in the casing wall, it is possible to prevent the secondary flow from creating a back flow, thereby preventing any abrupt reduction in head. Thus, it is possible to improve the stall margin while suppressing the reduction in peak efficiency at design point.

What is claimed is:

1. A turbomachine having an impeller rotating within a casing of said machine and circumferential groove passages formed in a wall of said casing between an upstream portion and a downstream portion of said impeller, characterized in that said machine comprises a high pressure fluid injecting means for injecting high pressure fluid having a velocity component opposite to a direction component of said impeller rotation into said groove passages formed in said casing.

2. A turbomachine claimed in claim 1, wherein said groove passages are formed in an area between said upstream portion and downstream portion of said impeller, and said high pressure fluid means inject high pressure fluid into said groove passages.

3. A turbomachine claimed in claim 2, wherein said upstream portion and downstream portion of said impeller include areas just beyond said impeller to the upstream and downstream of said impeller.

4. A turbomachine claimed in any one of claims 1 to 3, wherein said high pressure fluid injecting means are provided in said groove passages at said upstream portion of said impeller.

5. A turbo machine claimed in any one of claims 1, 2 or 3, wherein said high pressure fluid injecting means includes an injection stopping means for permitting and inhibiting injection of the high pressure fluid on demand.

6. A turbomachine claimed in claim 1, 2 or 3, wherein said high pressure fluid injection means utilizes, as said high pressure fluid, high pressure fluid from outside of said turbo machine.

7. A turbomachine claimed in any one of claims 1, 2 or 3, wherein said turbomachine is a multi-stage turbomachine, and said groove passages provided with said high pressure fluid injecting means are provided in at least one stage of said multi-stage machine.

8. A turbomachine claimed in any one of claims 1, 2 or 3, wherein said groove passages extend along an axial direction and are skewed in a circumferential direction counter to the impeller rotation.

9. A turbo machine claimed in any one of claim 1, 2 or 3, wherein said groove passages extend in a circumferential direction and are skewed axially of said impeller toward an outlet of said impeller.

10. A turbomachine claimed in any one of claim 1, 2 or 3, wherein said groove passages extend in a circumferential direction, and said high pressure fluid injection means comprises nozzles formed in said casing and opened to said groove passages facing toward a direction tangential to said groove passages so that a tip end opening of said nozzles project into said groove passages facing toward a direction tangential to said groove passages.

11. A turbomachine claimed in any one of claim 1, 2 or 3, wherein said groove passages extend in a circumferential direction, and said groove passages are interconnected to each other by a chamber extending axially of said impeller.

12. A turbomachine having an impeller rotating within a casing of said machine and axial groove passages formed in a wall of said casing between an upstream portion and a downstream portion of said impeller, characterized in that said machine comprises a high pressure fluid injecting means for injecting high pressure fluid having a velocity component opposite to a direction component of said impeller rotation into said groove passages formed in said casing.

* * * * *